US006058521A

United States Patent [19]

O'Brien

[11] Patent Number: 6,058,521

[45] Date of Patent: May 9, 2000

[54] COLLAPSIBLE SPA UNIT

[76] Inventor: Michael O'Brien, 8417 Littleton Rd., North Fort Myers, Fla. 33903

[21] Appl. No.: 08/965,444

[22] Filed: Nov. 6, 1997

[51] Int. Cl.[7] ..... E04H 4/04; A47K 3/06

[52] U.S. Cl. ..... 4/492; 4/506; 4/509; 4/541.1; 4/584

[58] Field of Search ..... 4/492, 509, 507, 4/506, 584, 585, 541.1

[56] References Cited

U.S. PATENT DOCUMENTS

| | | | |
|---|---|---|---|
| 3,233,251 | 2/1966 | Barrera | 4/506 X |
| 3,445,866 | 5/1969 | Shields | 4/506 X |
| 4,019,210 | 4/1977 | Patterson et al. | 4/492 |
| 5,054,135 | 10/1991 | Dallaire et al. | 4/506 X |
| 5,092,951 | 3/1992 | Popovich et al. | 4/584 X |
| 5,155,872 | 10/1992 | Aymes | 4/506 |
| 5,231,807 | 8/1993 | Aymes | 4/506 X |

*Primary Examiner*—David J. Walczak
*Assistant Examiner*—Kathleen J. Prunner
*Attorney, Agent, or Firm*—William E. Noonan

[57] ABSTRACT

A collapsible spa unit is disclosed including a base and a peripheral wall mounted to and extending above the base. The wall includes a plurality of discrete panels that are releasably interconnected to define an enclosed area. There is a liner that extends across an upper surface of the base and across an inside surface of each panel for holding water within the enclosed area. A conduit having jets is formed through the peripheral wall and the liner for conducting water into the enclosed area of the spa. A suction line is formed through the peripheral wall in the liner for discharging water out of the enclosed area. A pump located outside of the panels, and communicably interconnected with the conduit and suction line, draws water out of the enclosed area through the suction and reintroduces water into the enclosed area through the conduit.

14 Claims, 3 Drawing Sheets

COLLAPSIBLE SPA UNIT

FIELD OF THE INVENTION

This invention relates to a collapsible spa unit and, more particularly, to a portable spa that employs a plurality of releasably interconnected panels that form the walls of the spa.

BACKGROUND OF THE INVENTION

Bathing spas currently enjoy widespread popularity. These units are both therapeutic and relaxing. Recently, various portable spas have been introduced. These spas may be assembled and used in locations having limited space, such as apartments, lanais, porches, etc. A particularly convenient portable spa unit is disclosed in U.S. Pat. No. 5,548,852. This product features a durable, rugged construction but is lightweight and relatively easy to transport, store and assemble. As a result, busy individuals find it particularly convenient to use.

Despite recent improvements, portable spa units still exhibit a number of features that limit their convenience. Assembly and disassembly is usually a fairly complicated procedure. For example, the spa disclosed in U.S. Pat. No. 5,548,852 employs an internal tubular framework. Although this structure significantly enhances the strength of the unit and also provides a very unique and convenient water circulation system, the tubular framework complicates assembly, disassembly, transportation and storage of the product. The tubular components and connectors are fairly bulky and require considerable storage space. Fitting the pieces together requires time and patience. Other available portable spa units are even more complicated. As a result, moving, assembling and storing these spas is even more inconvenient.

SUMMARY OF INVENTION

It is therefore an object of the present invention to provide a collapsible spa unit that is extremely convenient to assemble, disassemble, transport and store.

It is a further object of this invention to provide a collapsible spa unit, which includes fewer and simpler components than are used by prior spa units and which is significantly quicker and easier to assemble and disassemble than known units.

It is a further object of this invention to provide a collapsible spa unit that provides users of the unit with hydrotherapy and relaxation.

It is a further object of this invention to provide a collapsible spa unit, which employs a simplified, yet improved circulation system effectively integrated into and mounted through the walls of the spa.

It is a further object of this invention to provide a spa unit that employs an improved, simplified and efficient construction for the walls of the spa.

It is a further object of this invention to provide a portable spa that is rugged and durable, yet very lightweight and convenient to handle.

It is a further object of this invention to provide a portable spa unit that may be quickly disassembled and compactly stored when not in use.

This invention features a collapsible spa unit that includes a base and a peripheral wall mounted to and extending above the base. The wall includes a plurality of discrete panels and means for releasably interconnecting the panels such that the panels define an enclosed area. Liner means extend across an upper surface of the base and across an inside surface of each panel for holding water within the enclosed area of the spa unit. Means are formed through the peripheral wall and the liner means for introducing water into the enclosed area. Means are formed through the peripheral wall and the liner means for discharging water from the enclosed area. The means for introducing and discharging are communicably connected. Means are provided for circulating water from the enclosed area of the spa through the means for discharging and back into the enclosed area through the means for introducing.

In a preferred embodiment, the means for releasably interconnecting include a plurality of angled connectors. Each connector is interengaged with a pair of adjacent panels and includes first means for gripping one of the adjacent panels and second means for gripping the other adjacent panel such that the adjacent panels form an angle of less than 180 degrees. The means for gripping may include an elongate slot that slidably receives a first one of the adjacent panels and the second means for gripping may include a second elongate slot that slidably receives a second one of the adjacent panels. Each panel typically includes a pair of vertical sides, a first pair of vertical grooves formed respectively on the inner and outer surfaces of the panel proximate one of the vertical sides, and a second pair of vertical grooves formed respectively on the inner and outer surfaces of the panel proximate the other vertical side. Each connector may include outer and inner detents that are slidably received by a respective pair of the outer and inner grooves such that the connector grips the panel.

The means for introducing may include a water transmitting conduit attached to the means for circulating and extending through an opening formed through one of the panels and into the enclosed area. The water transmitting conduit may have a plurality of water jets located within the enclosed area for delivering pumped water into the enclosed area. At least a portion of the water transmitting conduit may be secured to the liner means. An air transmitting conduit may extend through one of the panels and into the enclosed area. The air transmitting conduit may include a plurality of air jets located within the enclosed area of the spa. Air pump means may be connected to the air transmitting conduit for directing air into the air transmitting conduit. This air is directed by the air inlet ports into the enclosed area of the spa. Preferably, at least a portion of the air transmitting conduit is secured to the liner means. An enclosure may house the means for circulating and the air pump means. A suction filter is preferably connected to the means for discharging within the enclosed area of the spa.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
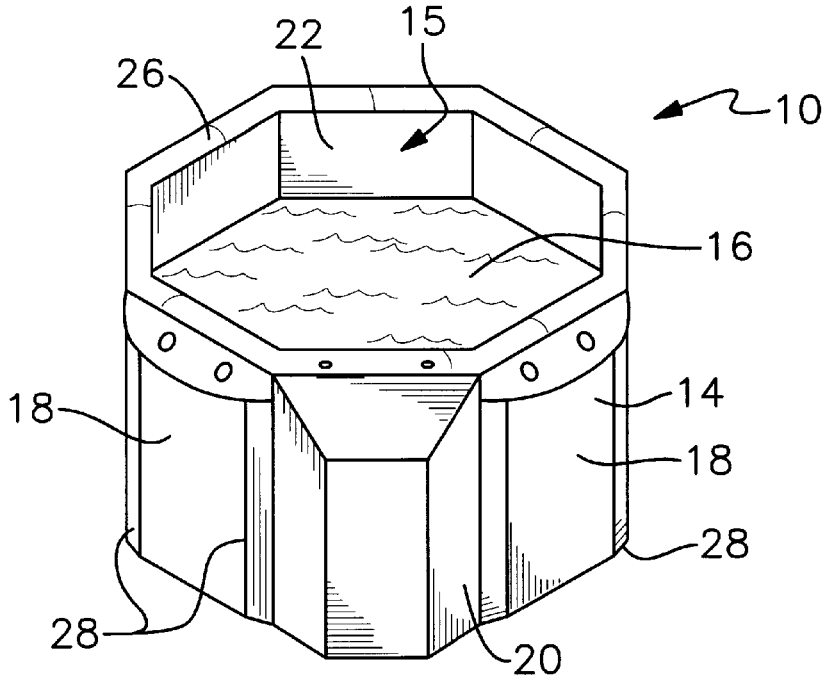
FIG. 1 is a perspective view of the collapsible spa unit of this invention.
Figure 2:
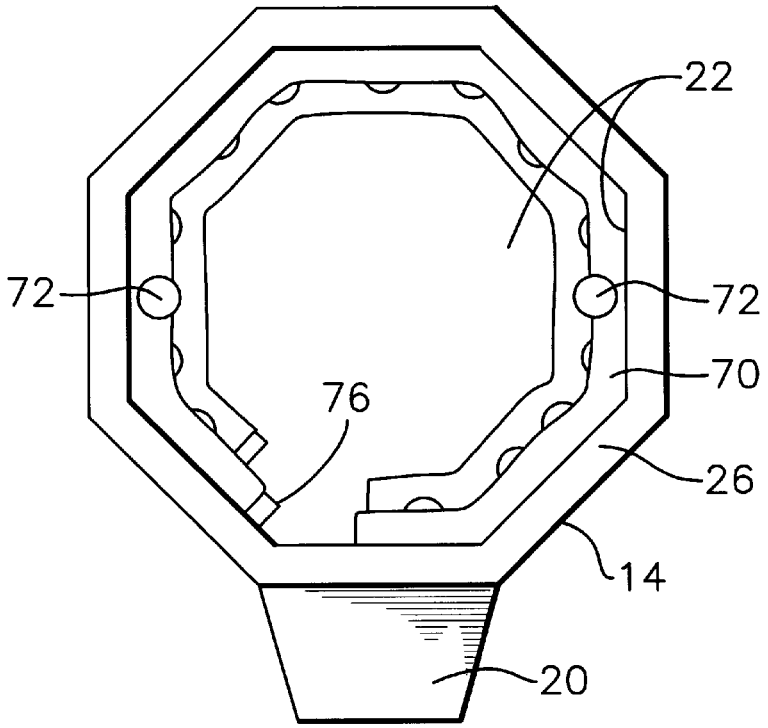
FIG. 2 is a plan view of the collapsible spa unit.

There is shown in FIGS. 1 and 2 a collapsible spa 10, which has a generally octagonal configuration. The spa has a base or floor 12, shown in FIG. 3. A peripheral wall 14 is sealably attached to and extends upwardly from the base. A liner 22 covers the interior surfaces of base 12 and wall 14. The structural details of the base, wall and liner, as well as their particular forms of interconnection are described more fully below. These components define an enclosed tub area 15 that is filled with water 16. This water is circulated through the spa to provide hydrotherapy for bathers seated in the spa. The system for circulating the water is likewise described more fully below.

Figure 3:
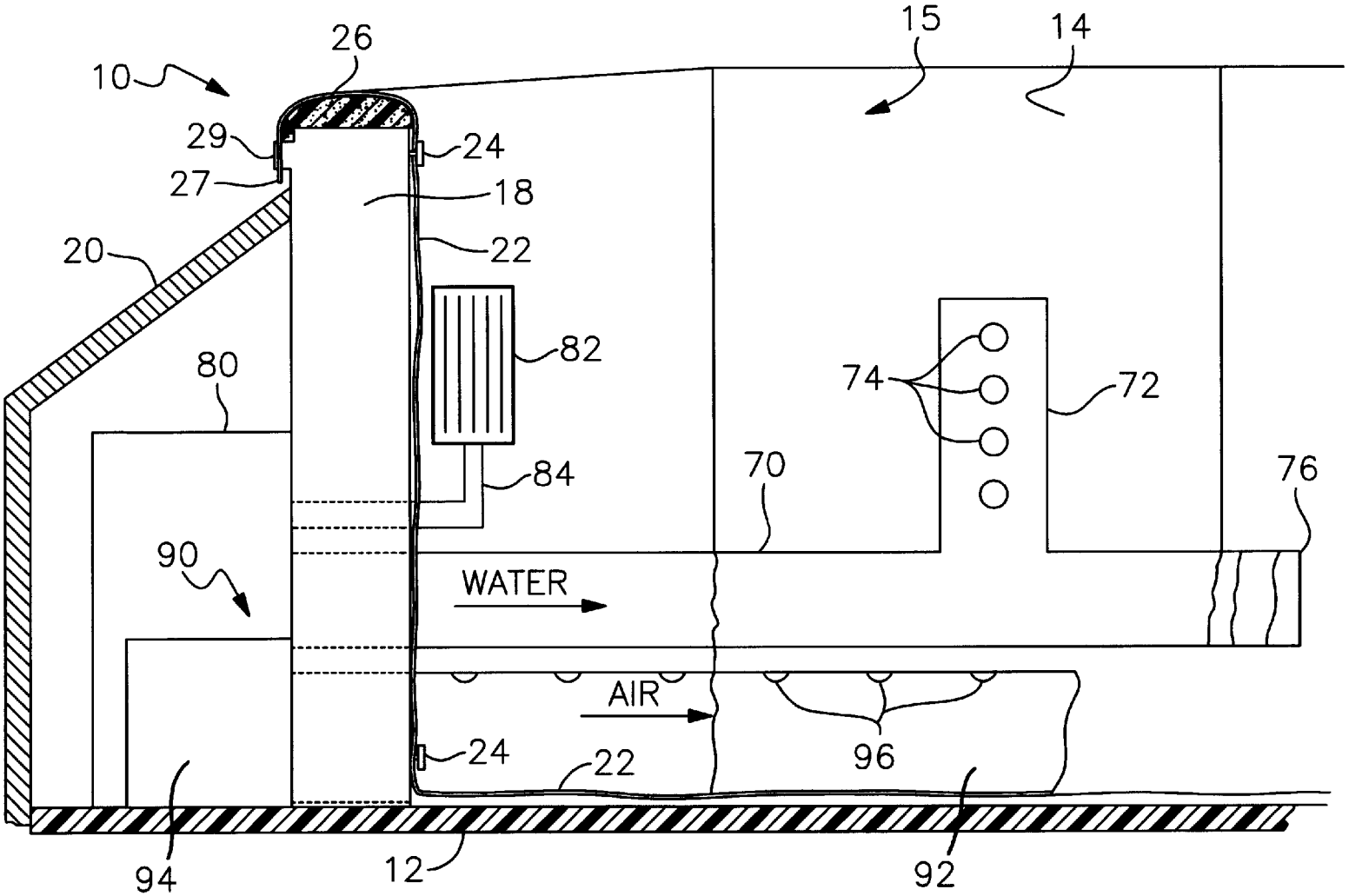
FIG. 3 is a cross sectional, partly schematic view of the spa unit and the circulation system used in the spa.

Base 12, FIG. 3, comprises a conventional foam pad. Wall 14 includes a plurality of discrete panels 18, FIG. 1, each of which has substantially flat inner and outer surfaces and generally defines a respective one of the sides of spa 10. In the octagonal spa embodiment shown herein, eight discrete panels 18 are employed. However, it should be noted that the spa may comprise various other numbers of sides. In each case, each panel 18 corresponds to one of the sides. Panels 18 are releasably interconnected, in a manner described below, to define the peripheral wall 14. The panels may be composed of various materials. Preferably, each panel includes a sheet of polystyrene or some other lightweight foam material that is coated with a water resistant plastic laminate. A wide variety of other natural and synthetic materials may also be employed. For example, a interior composed of foam or other lightweight material may be covered by a steel or wooden skin. Preferably, the interior of each panel comprises foam so that the weight of the collapsible panels is minimized.

As previously indicated, eight discrete panels 18 are used to construct the octagonal spa unit 10. In FIG. 1, two of the panels 18 are visible. An enclosure 20 is secured to wall 14 such that it obscures another intermediate panel. Enclosure 20 houses the air and water pumps of spa unit 10 in a manner that is described more fully below.

As illustrated in FIGS. 1–3, reinforced vinyl liner 22 extends across the upper surface of floor 12 and the inside surfaces of panels 18. Liner 22 comprises a durable, waterproof material of the type commonly used in spa and tub applications. The liner may be secured to base 12 and panels 18 by various means. For example, as shown in FIG. 3, the liner may be releasably secured to the panels 18 by snap fasteners 24. Various types of analogous fasteners may also be used to secure the liner to the padded base 12. Alternatively, heat welding and adhesives may be employed. In some versions, for ready assembly and disassembly, the liner is not attached to floor 12 at all. Rather, when the spa unit is assembled, the liner 22 is attached only to the inside surfaces of the wall panels 18, such as by fasteners 24. The weight of the water that is introduced into the spa urges the liner into engagement with the floor. Liner 22 is preferably composed of reinforced polyester or similar material that is both comfortable and durable. Even more importantly, this reinforcement provides necessary tensile and hoop strength for the liner so that it retains its integrity when the spa is filled with water.

A padded foam segment 26, FIGS. 1–3, is interconnected to the upper end of liner 22 and mounted along the upper edges of adjoining panels 18. Segment 26 comprises a marine grade foam material. As best shown in FIG. 3, the upper edge of the spa wall 14 has a rounded cross section. Segment 26 renders the spa aesthetically attractive and its soft foam composition permits bathers to rest their arms and shoulders comfortably against the upper edge of the spa wall. Liner 22 extends over segment 26. A piece 27 of reinforced plastic, unitary with or attached to the material composing liner 22, depends from the outer edge of padded segment 26. Snaps 29 secure piece 27 at various points along the outer surfaces of panels 18.

Figure 4:
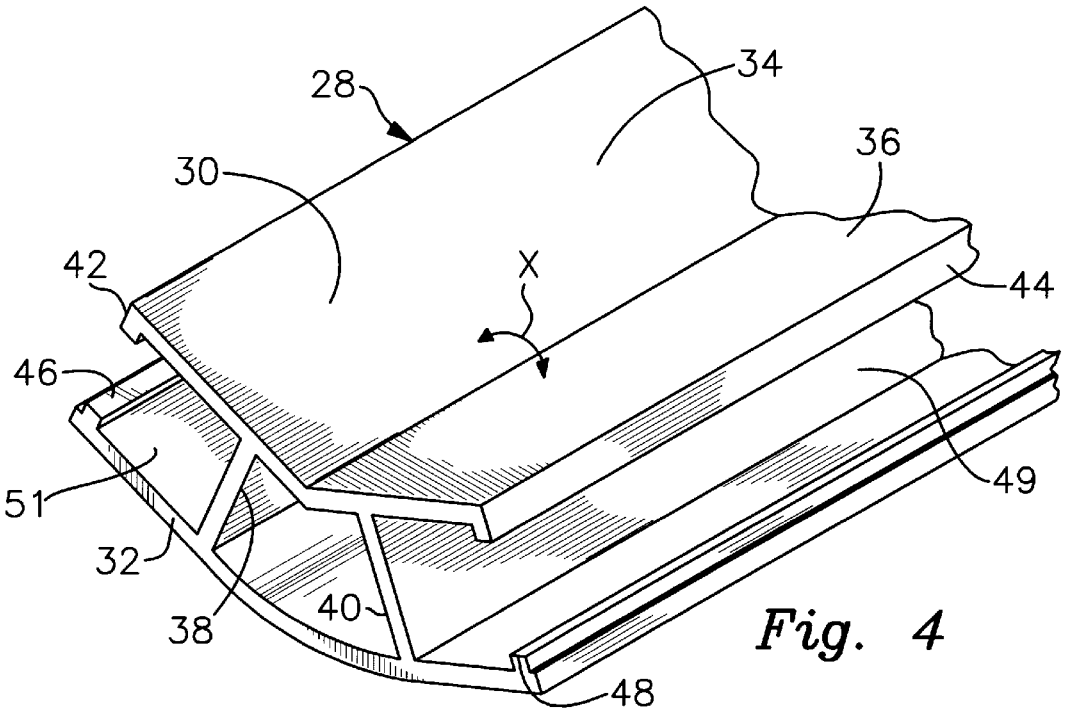
FIG. 4 is a perspective view of a portion of one of the angled connectors used to releasably interconnect an adjacent pair of wall panels in the spa unit.

The wall panels 18 are releasably interconnected by a plurality of angled connectors 28. A representative connector 28 is illustrated in FIG. 4. Each connector includes an elongate angled section 30 and an elongate curved section 32. Angled section 30 comprises a pair of elongate legs 34 and 36 that are joined at an angle corresponding to the desired angle to be formed between the sides or panels of the spa. For example, in the octagonal spa embodiment, angle X is 135 degrees, which corresponds to the angle between each pair of adjacent sides or panels 18 of the spa.

Connector sections 30 and 32 are permanently interconnected by a pair of elongate elements 38 and 40. More specifically, element 38 extends between section 32 and leg 34 of section 30. Element 40 likewise extends between section 32 and segment 36 of section 30. Each of elongate connector sections 30 and 32 carries a pair of detents. In particular, leg 34 of angled section 30 carries an elongate detent 42 along the distal edge thereof. Leg 36 carries a similar longitudinal detent 44 along its distal edge. Curved section 32 carries a first longitudinal detent 46 and a second longitudinal detent 48, which are formed proximate respective longitudinal edges of section 32. Unlike the detents carried by the angled member, the detents 46 and 48 carried by curved member 32 are formed only proximate and not along the longitudinal edges of the curved member. In alternative embodiments, these detents may be formed precisely along the longitudinal edges. In any event, the detents described above are formed integrally with their respective elongate connector sections. Indeed, the entire connector 28 is typically a unitary, one piece component. Preferably, the connector is formed from a durable molded plastic material.

According to the above described construction, channel 28 forms two elongate slots 49 and 51. Channel 49 is formed by detent 44, a portion of leg 36, element 40, a portion of section 32 and detent 48. Similarly, channel 51 is formed by detent 42, a portion of leg 34, element 38, a portion of member 32 and detent 46. These channels act as means for gripping respective panels 18 in a manner described more fully below.

Figure 5:
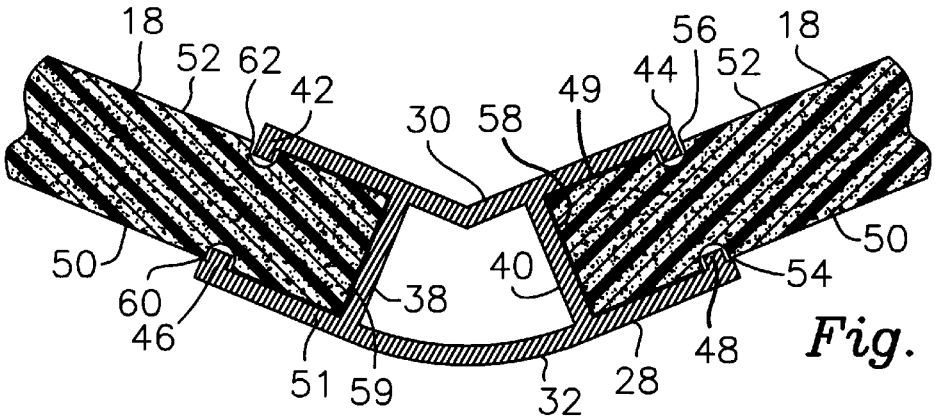
FIG. 5 is a cross sectional view of the angled connector and a pair of discrete wall panels releasably gripped by the connector.

Each connector 28 releasably grips and interconnects an adjacent pair of panels 18 in the manner best shown in FIG. 5. Each panel 18 has a laminated plastic outside surface 50 and a similar inside surface 52 that define respective planar sides of the panel. Each panel includes a pair of vertical grooves 54 and 56 formed respectively on surfaces 50 and 52 proximate a vertical edge 58 of the panel. A second pair of vertical grooves 60 and 62 are formed respectively on surfaces 50 and 52 proximate the other vertical edge 59 of the panel. In FIG. 5, the first pair of grooves 54 and 56 are shown on one of the adjacent panels 18 and the second pair of grooves 60 and 62 are illustrated on the adjacent panel 18. It should be understood that each panel includes all four grooves 54, 56, 60 and 62. One vertical edge and one pair of the grooves are omitted from each of the panels in FIG. 5 for clarity. Each of these grooves extends vertically for the full height of the panel along a respective inside or outside surface of the panel. Typically, plastic laminate coats the groove as well as the remaining planar surface of the panel.

Elongate slot 49 receives one of the adjacent panels 18. Elongate slot 51 similarly receives the other panel. In particular, detent 44 fits in groove 56, detent 48 fits in groove 54, detent 42 fits in groove 62 and detent 46 fits in groove 60. Because the surfaces of the grooves are coated by the laminated plastic, the adjacent panels are easily and slidably interengaged with respective channels 49 and 51 of connector 28. A pair of adjacent panels 18 are attached to each connector 28. Likewise, each individual panel is gripped along its vertical edges by a pair of connectors 28. Specifically, each panel 18 is aligned with one of the slots 49 and 51 in one connector 28 and the other of those slots in an adjacent connector. Each pair of grooves, 54, 56 and 60, 62 is aligned with a respective pair of detents 48, 44 and 46, 42. The panel is then inserted into slot 49 of one connector 28 and slot 51 of the adjacent connector such that each detent slidably interengages a respective vertical groove. In this manner, the panels are quickly and easily assembled and disassembled to form wall 14 of spa 10. To fully assemble the wall, each panel 18 is interconnected in the above manner between a pair of connectors and each connector joins an adjacent pair of panels and holds those panels at a desired angle X. When all of the connectors and adjoining pairs of panels have been interengaged, a closed, peripheral wall defining the enclosed area of the spa is completed.

As shown in FIG. 3, water is introduced into the enclosed area of spa 10 by a water circulating conduit 70. This conduit extends along the periphery of wall 14 proximate floor 12 and is secured to the liner 22 of the spa by heat welding or other known means. The conduit typically comprises a reinforced vinyl material, which may be similar in construction to the liner of the spa. A pair of vertical conduit segments 72, also shown in FIG. 2, are communicably connected to and extend upwardly from conduit 70. Preferably the conduits and conduit segments are heat welded or otherwise secured to liner 22 along the respective longitudinal edges thereof. Each conduit segment 72 is provided with a plurality of holes or ports defining water jets 74. Conduit 70 extends for any desired distance about the inside periphery of the pool and includes a sealed end 76 formed at any selected location. Water is introduced into the conduit by a water pump 80 that is located within enclosure 20. The enclosure may be secured to the outside of wall 14 by any suitable means. Water pump 80 may comprise any standard type of circulation pump of the type known by those skilled in the pool or spa arts. Water is drawn by pump 80 from the interior of pool 10 through a suction filter 82 and a discharge line 84. The discharge line and conduit 70 are operably interengaged with pump 80. Additionally, line 84 and conduit 70 extend conveniently through respective openings in one of the panels 18. A preferred manner of interconnecting these lines with pump 80 through panel 18 is shown below in conjunction with FIG. 6.

Spa 10 also includes an aerator assembly 90. This device comprises an elongate, generally tubular conduit 92 that is interconnected to an aeration pump 94 through a panel 18. Typically this is the same panel through which conduit 70 extends. More particularly, conduit 92 is constructed from vinyl that is identical or similar to that composing the liner. Conduit 92 is preferably heat welded or otherwise securely fastened along its longitudinal edges to the liner proximate the junction of the floor and the wall. As with the water circulation conduit, the aeration conduit may extend for any desired distance about the periphery of the pool. The aeration conduit 92 is mounted somewhat below the water circulation conduit (or at other locations) and includes a plurality of aeration holes or perforations 96 that are formed along the length of conduit 92. These define air jets.

Figure 6:
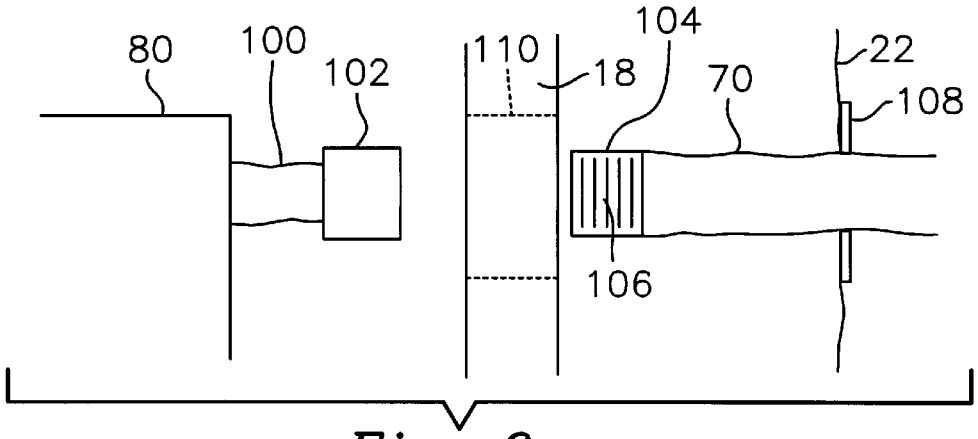
FIG. 6 is an elevational and exploded side view of the spa wall and interior liner with the components of a representative one of the conduits exposed and detached to illustrate how the conduits are formed through the side wall of the spa.

A preferred manner of interconnecting the water circulation pump 80 with the water transmitting conduit 70 is illustrated in FIG. 6. It should be noted that a similar construction may be employed for interconnecting the aeration pump with the aeration conduit. Likewise, the water return line 84 may be analogously interconnected to the pump 80. Specifically, a tube segment 100 extends from pump 80 and includes an end fitting 102. This is typically an annular component that has an internally threaded surface, not shown. Conduit 70 likewise includes an end fitting 104 having an externally threaded surface 106. Conduit 70 extends through an opening in liner 22 and is sealably attached thereto by a flange 108 that is heat welded to the conduit and the liner. Panel 18 includes an opening 110 through which tubular segment 100 and conduit 70 extend and are threadably interconnected. Again, it should be understood that a similar means of connection may be used for return line 84 and pump 80, as well as for aeration conduit 92 and aeration pump 94.

In operation, the water circulation pump 80 is operated to circulate water through conduit 70 and jets 74 into the spa. At the same time, water in the pool is drawn through filter 82 and return outlet line 84 back into pump 80. If desired, aeration pump 94 is operated to deliver air through conduit 92. The air escapes through perforations or jets 96 so that therapeutic bubbles are produced. During operation of the pump, the rugged construction and strength of the panels, connectors and liner ensure the strength and integrity of the spa unit.

Between uses, spa 10 is readily disassembled. First, water is drained from the unit through a discharge outlet, not shown. The liner is unsnapped from the panels 18 and removed. The panels are then slidably disengaged from the angled connectors 28. The flat panels are lightweight and easy to store. The liner and the padded floor are likewise simple to fold and store. All components of the invention are readily transported between desired locations. The unit is very compact so that it can be easily hidden from view when not in use. The flat, easily disengageable panels facilitate storage.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A collapsible spa unit comprising:

a base;

a peripheral wall mounted to and extending above said base, said wall including a plurality of discrete planar panels devoid of any outward projections and each of which has substantially flat inner and outer surfaces and means for releasably interconnecting said panels such that said panels define an enclosed area, said means for releasably interconnecting including a plurality of angled connectors, each said connector being interengaged with a pair of adjacent panels and including first means for gripping one of said adjacent panels and second means for gripping the other said adjacent panel such that said inside surfaces of said panels form an angle of less than 180 degrees;

liner means that extend across an upper surface of said base and across said inside surface of each said panel for holding water within said enclosed area of said spa unit;

means formed through said peripheral wall and said liner means for introducing water into said enclosed area of said spa unit;

means formed through said peripheral wall and said liner means for discharging water from said enclosed area of said spa unit, said means for introducing and said means for discharging being communicably connected; and means for circulating water from said enclosed area through said means for discharging and back into said enclosed area through said means for introducing.

2. The unit of claim 1 in which said first means for gripping include an elongate slot that slidably receives said one of said adjacent panels and said second means for gripping includes a second elongate slot that slidably receives said other adjacent panel.

3. The unit of claim 1 in which each said panel includes a pair of vertical sides, a first pair of vertical grooves formed respectively on said outer and inner surfaces of said panel proximate one of said vertical sides and a second pair of generally vertical grooves formed respectively on said inner and outer surfaces of said panel proximate the other said vertical side and in which each said connector includes outer and inner detents that are slidably received by a respective pair of said outer and inner grooves whereby said connector grips said panel.

4. The unit of claim 1 in which said means for introducing include a water transmitting conduit attached to said means for circulating and extending through an opening formed in one of said panels and into said enclosed area, said water transmitting conduit having means defining a plurality of water jets located within said enclosed area for delivering pumped water into said enclosed area.

5. The unit of claim 4 in which at least a portion of said water transmitting conduit is secured to said liner means.

6. A collapsible spa unit comprising:

a base;

a peripheral wall disposed about and extending above said base, said wall including a plurality of planar panels devoid of any outward projections and each of which has substantially flat inner and outer surfaces, said panels being arranged side by side and defining an enclosed area, each panel being disposed at an angle of less than 180 degrees relative to each adjacent panel and being joined to each said adjacent panel by an angled connector that is separate and distinct from said adjacent panel;

liner means that extend across an upper surface of said base and across said inside surface of each said panel for holding water within said enclosed area of said spa unit;

means formed through said peripheral wall and said liner means for introducing water into said enclosed area of said spa unit;

means formed through said peripheral wall and said liner means for discharging water from said enclosed area of said spa unit, said means for introducing and said means for discharging being communicably connected; and means for circulating water from said enclosed area through said means for discharging and back into said enclosed area through said means for introducing.

7. The unit of claim 6 further including an air transmitting conduit that extends through one of said panels and into said enclosed area, said air transmitting conduit including a plurality of air jets located within said enclosed area, and air pump means connected to said air transmitting conduit for directing air into said air transmitting conduit, which air is directed by said air jets into said enclosed area.

8. The unit of claim 7 in which at least a portion of said air transmitting conduit is secured to said liner means.

9. The unit of claim 7 further including an enclosure disposed outside of said enclosed area for housing said means for circulating and said air pump means, said means for introducing and said means for discharging being interconnected to said means for circulating through at least one opening in said peripheral wall, said air transmitting conduit extending through a respective hole in said peripheral wall.

10. The unit of claim 9 further including a pair of openings in one of said panels, each of said means for introducing and said means for discharging being interconnected to said means for circulating through a respective one of said openings, said hole being formed through said panel which has said pair of openings.

11. The unit of claim 6 further including an enclosure disposed outside of said enclosed area for housing said means for circulating, said means for introducing and said means for discharging being interconnected to said means for circulating through at least one opening in said peripheral wall.

12. The unit of claim 11 further including a pair of openings in one of said panels, each of said means for introducing and means for discharging being interconnected to said means for circulating through a respective one of said openings.

13. The unit of claim 6 in which a suction filter is operably connected to said means for discharging within said enclosed area.

14. The spa unit of claim 6 in which each panel includes a one-piece construction and wherein each panel corresponds to a respective side of the spa unit.

* * * * *